US009328651B2

(12) United States Patent
Arino

(10) Patent No.: US 9,328,651 B2
(45) Date of Patent: May 3, 2016

(54) HEAT EXCHANGER

(71) Applicant: KEIHIN THERMAL TECHNOLOGY CORPORATION, Oyama-shi (JP)

(72) Inventor: Kouta Arino, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 257 days.

(21) Appl. No.: 14/024,633

(22) Filed: Sep. 12, 2013

(65) Prior Publication Data

US 2014/0069610 A1 Mar. 13, 2014

(30) Foreign Application Priority Data

Sep. 12, 2012 (JP) ..... 2012-200035

(51) Int. Cl.

| | |
|---|---|
| ***F28F 9/02*** | (2006.01) |
| ***F01P 11/02*** | (2006.01) |
| ***F28D 1/053*** | (2006.01) |
| ***F28F 9/00*** | (2006.01) |

(52) U.S. Cl.

CPC ..... *F01P 11/0276* (2013.01); *F28D 1/05366* (2013.01); *F28D 1/05375* (2013.01); *F28F 9/001* (2013.01); *F28F 9/0212* (2013.01); *F28F 9/0243* (2013.01)

(58) Field of Classification Search

CPC ..... F28F 9/04; F28F 9/02; F28F 9/22; F01P 11/0276; F28D 1/05366

USPC ..... 165/71, 148, 151, 153, 174, 175, 173

See application file for complete search history.

(56) References Cited

U.S. PATENT DOCUMENTS

| | | | | | |
|---|---|---|---|---|---|
| 5,586,600 | A * | 12/1996 | Cribari | F28F 9/0212 | 165/173 |
| 5,607,012 | A * | 3/1997 | Buchanan | F28F 9/0212 | 165/173 |
| 5,782,295 | A * | 7/1998 | Kato et al. | 165/174 | |
| 5,898,996 | A * | 5/1999 | Buchanan | B21D 28/28 | 29/890.052 |
| 6,234,238 | B1 * | 5/2001 | Koyama | F28D 1/05375 | 165/133 |
| 6,604,574 | B1 * | 8/2003 | Loomis | F28F 9/0224 | 165/173 |
| 6,662,863 | B2 * | 12/2003 | Igami et al. | 165/174 | |
| 6,883,600 | B2 * | 4/2005 | Mano | B60K 6/40 | 165/140 |
| 2003/0010484 | A1 * | 1/2003 | Chikuma et al. | 165/174 | |
| 2005/0211425 | A1 * | 9/2005 | McKittrick et al. | 165/174 | |
| 2010/0025028 | A1 * | 2/2010 | Shinhama et al. | 165/174 | |
| 2010/0108303 | A1 * | 5/2010 | Sundralingam et al. | 165/153 | |
| 2015/0027161 | A1 * | 1/2015 | Ohtani et al. | 62/515 | |

FOREIGN PATENT DOCUMENTS

| | | | |
|---|---|---|---|
| JP | 2008-051456 | 3/2008 | |
| JP | 2011-290120 | * 12/2011 | F28F 9/02 |

* cited by examiner

*Primary Examiner* — Leonard R Leo
*Assistant Examiner* — Gustavo Hincapie Serna
(74) *Attorney, Agent, or Firm* — Mori & Ward, LLP

(57) ABSTRACT

The tank main body of a header tank of a condenser has slits formed in a circumferential wall thereof at positions between opposite end surfaces of the circumferential wall and heat exchange tubes at the opposite ends. Plate-shaped closure members are inserted into the slits from the outside of the tank main body and joined to the circumferential wall of the tank main body. Drain openings are formed in the circumferential wall of the tank main body at positions on the outer sides of the closure members as viewed in the longitudinal direction of the tank main body. A portion of a surface of each closure member which faces outward in the longitudinal direction of the tank main body forms a portion of a peripheral edge of the corresponding drain opening.

7 Claims, 5 Drawing Sheets

HEAT EXCHANGER

BACKGROUND OF THE INVENTION

The present invention relates to a heat exchanger.

A heat exchanger used as a condenser for a car air conditioner is known (Japanese Patent Application Laid-Open (kokai) No. H7-35442). The heat exchanger includes a pair of header tanks disposed apart from each other such that their longitudinal direction coincides with a vertical direction; a plurality of heat exchange tubes disposed between the header tanks such that their longitudinal direction coincides with a horizontal direction and they are spaced apart from one another along the longitudinal direction of the header tanks, the heat exchange tubes having opposite end portions connected to the corresponding header tanks; fins disposed between adjacent heat exchange tubes and on the outer sides of the heat exchange tubes at the opposite ends; and side plates which are disposed on the outer sides of the fins at the opposite ends and whose opposite ends are joined to the corresponding header tanks. Each header tank has a tubular tank main body which is open at opposite ends thereof, and closure members press-fitted into the tank main body so as to close the openings of the tank main body at opposite ends thereof. The closure members are located at portions of the circumferential wall of the tank main body of each header tank, which portions are located between the opposite end surfaces of the circumferential wall and the heat exchange tubes at the opposite ends. The opposite end portions of the side plates are inserted into through-holes which are formed in the circumferential walls of the tank main bodies of the two header tanks to be located outward of the closure members as viewed in the longitudinal direction of the tank main bodies. The opposite end portions of the side plates are brazed to the circumferential walls of the tank main bodies. Water drain holes (through-holes) are formed in the circumferential walls of the tank main bodies to be located outward of the closure members as viewed in the longitudinal direction of the tank main bodies.

However, in the case of the heat exchanger disclosed in the publication, since the distance between the outer surface of each closure member and a corresponding drain hole is large, water collecting between the outer surface of each closure member and a corresponding drain hole cannot be drained. Therefore, the heat exchanger is poor in water draining performance and may decrease in corrosion resistance.

SUMMARY OF THE INVENTION

An object of the present invention is to solve the above-described problem and to provide a heat exchanger which has an improved performance of draining water which collects in spaces within the tank main bodies of header tanks, which spaces are located on the outer sides of closure members.

To fulfill the above object, the present invention comprises the following modes.

1) A heat exchanger comprising a pair of header tanks disposed apart from each other; a plurality of heat exchange tubes disposed in parallel between the header tanks and having opposite end portions connected to the respective header tanks; fins disposed between adjacent heat exchange tubes and on the outer sides of the heat exchange tubes at opposite ends; and side plates which are disposed on the outer sides of the fins at the opposite ends and whose opposite ends are joined to the corresponding header tanks, each of the header tanks having a tubular tank main body which is open at opposite ends thereof, and closure members which close the openings of the tank main body at opposite ends thereof, wherein slits are formed in a circumferential wall of the tank main body of each header tank at positions between opposite end surfaces of the circumferential wall and the heat exchange tubes at the opposite ends such that the slits extend in the circumferential direction of the circumferential wall;

the closure members each having a plate-like shape are inserted into the slits from the outer side of the tank main body and are joined to the circumferential wall of the tank main body;

insertion openings for receiving corresponding ones of opposite ends of the side plates are formed in the circumferential wall of the tank main body of each header tank at positions on the outer sides of the closure members as viewed in the longitudinal direction of the tank main body;

the opposite ends of the side plates are inserted into the insertion openings of the circumferential walls of the tank main bodies of the two header tanks and are joined to the circumferential walls of the tank main bodies;

drain openings are formed in the circumferential wall of the tank main body of each header tank at positions on the outer sides of the closure members as viewed in the longitudinal direction of the tank main body; and a portion of a surface of each closure member which faces outward in the longitudinal direction of the tank main body forms a portion of a peripheral edge of the corresponding drain opening.

2) A heat exchanger according to par. 1), wherein the slits are formed in a portion of the circumferential wall of each tank main body located on the side opposite the side where the heat exchange tubes are connected to the tank main body, each closure member has a main body portion which closes a space surrounded by the circumferential wall of the tank main body, and an outward projecting portion unitarily formed at a portion of the peripheral edge of the main body portion, and an outer edge portion of the outward projecting portion extends through the corresponding slit to the outside of the circumferential wall of the tank main body.

3) A heat exchanger according to par. 2), wherein each closure member has a protrusion which is provided at the peripheral edge of the main body portion to be located on the side opposite the outward projecting portion, and the protrusion is inserted into a through-hole which is formed in a portion of the circumferential wall of the tank main body on the side where the heat exchange tubes are connected to the tank main body.

4) A heat exchanger according to par. 1), wherein each drain opening is a cutout which is formed in the circumferential wall of the tank main body, and the cutout extends from a corresponding end surface of the circumferential wall of the tank main body toward the corresponding slit and reaches an edge portion of the slit located on the outer side in the longitudinal direction of the tank main body.

5) A heat exchanger according to par. 1), wherein each drain opening is a cutout which is formed in the circumferential wall of the tank main body, and the cutout extends from an edge portion of the slit located on the outer side in the longitudinal direction of the tank main body, toward the corresponding end surface of the circumferential wall of the tank main body, and an end portion of the cutout on the outer side in the longitudinal direction of the tank main body is located between the slit and the corresponding end surface of the circumferential wall of the tank main body.

6) A heat exchanger according to par. 1), wherein the insertion openings of the circumferential wall of each tank main body are cutouts which are formed in the circumferential wall of the tank main body such that the cutouts extend from opposite end surface of the circumferential wall of the tank main body.

7) A heat exchanger according to par. 1), wherein the insertion openings of the circumferential wall of each tank main body are through-holes which are formed in the circumferential wall of the tank main body.

According to the heat exchanger of par. 1), slits are formed in a circumferential wall of the tank main body of each header tank at positions between opposite end surfaces of the circumferential wall and the heat exchange tubes at the opposite ends such that the slits extend in the circumferential direction of the circumferential wall, plate-shaped closure members are inserted into the slits from the outer side of the tank main body and are joined to the circumferential wall of the tank main body, insertion openings for receiving corresponding ones of opposite ends of the side plates are formed in the circumferential wall of the tank main body of each header tank at positions on the outer sides of the closure members as viewed in the longitudinal direction of the tank main body, the opposite ends of the side plates are inserted into the insertion openings of the circumferential walls of the tank main bodies of the two header tanks and are joined to the circumferential walls of the tank main bodies, drain openings are formed in the circumferential wall of the tank main body of each header tank at positions on the outer sides of the closure members as viewed in the longitudinal direction of the tank main body, and a portion of a surface of each closure member which faces outward in the longitudinal direction of the tank main body forms a portion of a peripheral edge of the corresponding drain opening. Therefore, water collecting in spaces within the tank main body of each header tank, which spaces are located on the outer sides of the closure members as viewed in the longitudinal direction of the tank main body, can be drained efficiently, whereby lowering of the corrosion resistance of the header tanks can be prevented.

Also, even when a large load acts on a side plate and separation occurs at the joint portions between the opposite end portions of the side plate and the tank main bodies, leakage of fluid from the header tanks can be prevented. Therefore, in the case where this heat exchanger is used as a condenser of a refrigerant cycle which constitutes, for example, a car air conditioner, it becomes possible to attach the condenser to the interior of the engine compartment of an automobile by making use of the side plates or to attach other components to the side plates.

According to the heat exchanger of par. 2), a portion of the outward projecting portion of each closure member is sandwiched between portions of the circumferential wall of the tank main body located on the upper and lower sides of the corresponding slit. Therefore, the closure members can be reliably positioned in the longitudinal direction of the tank main body.

According to the heat exchanger of par. 3), the protrusion of the main body portion of each closure member is inserted into the corresponding through-hole formed in the circumferential wall of the tank main body. Therefore, the positioning of the closure members in the longitudinal direction of the tank main body can be performed more reliably.

DESCRIPTION OF THE PREFERRED EMBODIMENTS

Embodiments of the present invention will next be described with reference to the drawings. In the embodiments, a heat exchanger according to the present invention is applied to a condenser of a car air conditioner.

Figure 1:
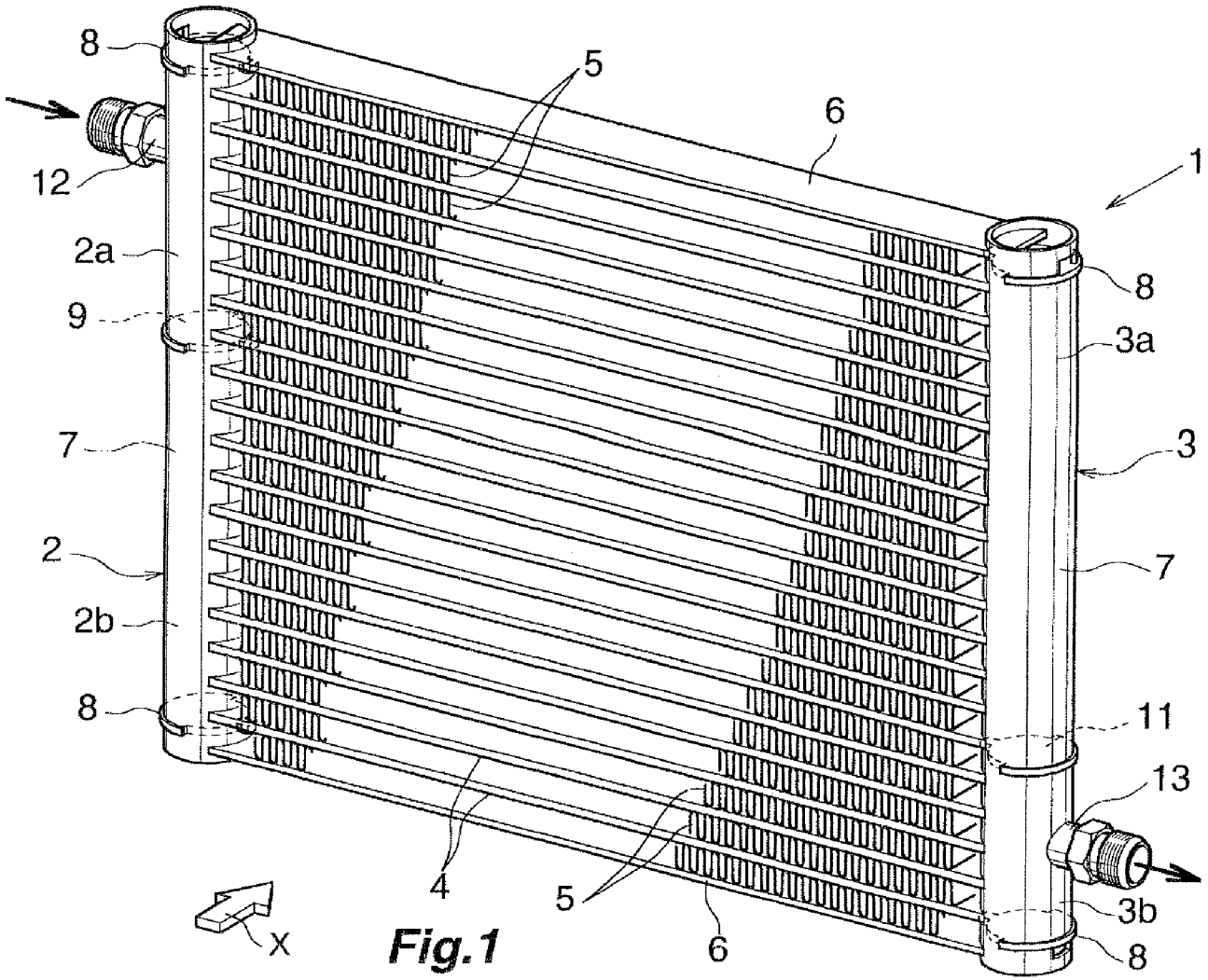
FIG. 1 is a perspective view showing the overall structure of a condenser to which a heat exchanger according to the present invention is applied.

In the following description, a direction indicated by an arrow X in FIG. 1 is a direction in which air flows. The upper, lower, left-hand, and right-hand sides when the leeward side is viewed from the windward side; i.e., the upper, lower, left-hand, and right-hand sides of FIG. 1, will be referred to as "upper," "lower," "left," and "right," respectively. Also, the term "aluminum" encompasses aluminum alloys in addition to pure aluminum.

Further, the same portions and members are denoted by the same reference numerals throughout all the drawings, and redundant descriptions will be omitted.

Figure 2:
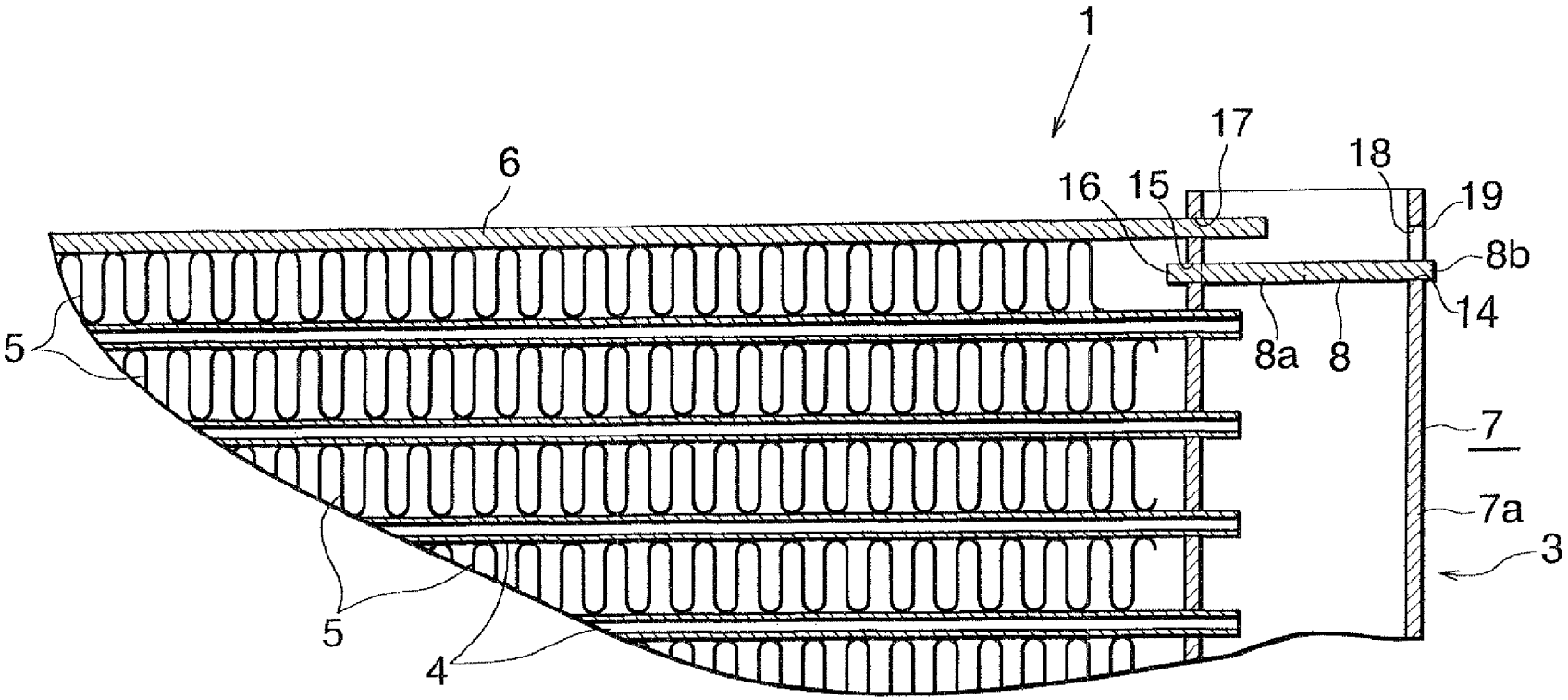
FIG. 2 is a vertical cross-sectional view of a portion of the condenser of FIG. 1 as viewed from the windward side thereof.

As shown in FIGS. 1 and 2, a condenser 1 includes a pair of header tanks 2 and 3 formed of aluminum, a plurality of flat heat exchange tubes 4 formed of aluminum, corrugated fins 5 formed of aluminum, and side plates 6 formed of aluminum. The header tanks 2 and 3 are disposed such that their longitudinal direction coincides with a vertical direction and they are spaced apart from each other in a left-right direction. The heat exchange tubes 4 are disposed between the two header tanks 2 and 3 such that their width direction coincides with an air-passing direction, their longitudinal direction coincides with the left-right direction, and they are spaced apart from each other in the vertical direction. Opposite end portions of the heat exchange tubes 4 are connected to the corresponding header tanks 2 and 3. Each of the corrugated fins 5 is disposed between adjacent heat exchange tubes 4, on the upper side of the upper-end heat exchange tube 4, or on the lower side of the lower-end heat exchange tube 4. The corrugated fins 5 are brazed to the corresponding heat exchange tubes 4. The side plates 6 are disposed on the upper side of the upper-end corrugated fin 5 and on the lower side of the lower-end corrugated fin 5, and are brazed to these corrugated fins 5.

Each of the header tanks 2 and 3 of the condenser 1 is composed of a tubular tank main body 7 which is formed of aluminum and which is open at opposite ends thereof, and plate-shaped closure members 8 which are formed of aluminum and which are brazed to opposite ends of the tubular tank main body 7 so as to close the openings of the tank main body at opposite ends thereof. The left header tank 2 is divided into upper and lower header sections 2*a* and 2*b* by a partition member 9 at a position above the center in the height direction. The right header tank 3 is divided into upper and lower header sections 3*a* and 3*b* by a partition member 11 at a position below the center in the height direction. An inlet member 12 which is formed of aluminum and which communicates with the interior of the upper header section 2*a* is brazed to a portion of the tank main body 7 of the left header tank 2, which portion is located above the partition member 9. An outlet member 13 which is formed of aluminum and which communicates with the interior of the lower header section 3*b* is brazed to a portion of the tank main body 7 of the right header tank 3, which portion is located below the partition member 11.

Figure 3:
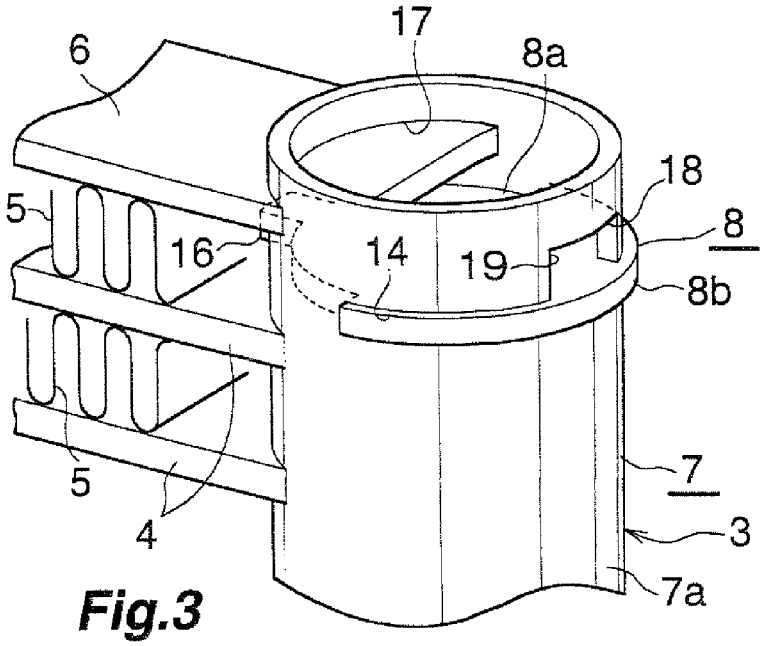
FIG. 3 is an enlarged perspective view showing a main portion of a right header tank of the condenser of FIG. 1.
Figure 4:
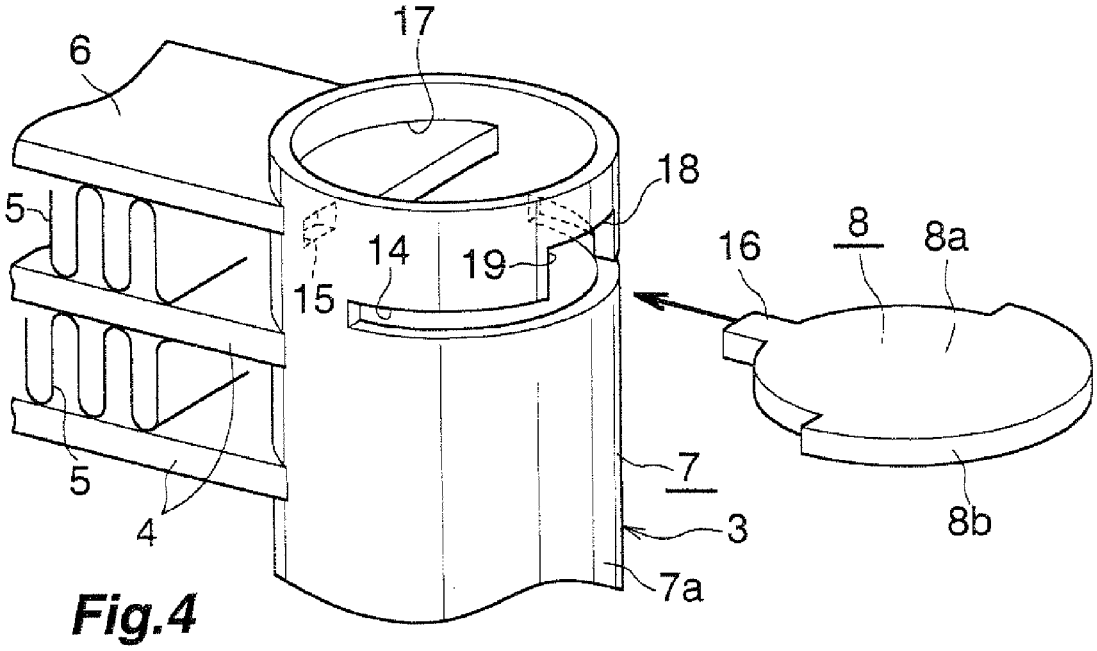
FIG. 4 is an exploded perspective view showing a portion of the condenser of FIG. 1, which portion is the same as the portion shown in FIG. 3.

As shown in FIGS. 2 to 4, the tank main body 7 of the right header tank 3 has slits 14 and through-holes 15. The slits 14 are formed in a portion of the circumferential wall 7*a* located on the outer side in the left-right direction (a portion of the circumferential wall 7*a* located opposite the side where the heat exchange tubes 6 are connected to the circumferential wall 7*a*) at positions between opposite ends surfaces of the circumferential wall 7*a* and the heat exchange tubes 4 at the upper and lower ends. The slits 14 extend over above a half of the circumferential wall 7*a* in the circumferential direction. The through-holes 15 are formed in a portion of the circumferential wall 7*a* located on the inner side in the left-right direction such that the through-holes 15 are located at the same heights as the corresponding slits 14. Each closure member 8 has a main body portion 8*a* which closes a space surrounded by the circumferential wall 7*a* of the tank main body 7, and an outward projecting portion 8*b* which is unitarily formed at a right-side portion of the peripheral edge of the main body portion 8*a*. Also, a protrusion 16 is unitarily formed at a left end portion of the peripheral edge of the main body portion 8*a* of the closure member 8. An outer edge portion of the outward projecting portion 8*b* of the closure member 8 extends through the corresponding slit 14 to the outside of the circumferential wall 7*a*. The closure member 8 is fitted into the slit 14 from the outside of the tank main body 7, and the projection 16 is inserted into the through-hole 15. An end portion of the projection 16 is crimped externally, whereby the projection 16 is provisionally fixed to the tank main body 7, and the closure member 8 is positioned in the longitudinal direction of the tank main body 7. In this state, the closure member 8 is brazed to the circumferential wall 7*a* of the tank main body 7. Since the outer edge portion of the outward projecting portion 8*b* of the closure member 8 extends through the corresponding slit 14 to the outside of the circumferential wall 7*a*, in a state before the closure member 8 is brazed to the circumferential wall 7*a*, a portion of the outward projecting portion 8*b* is sandwiched between portions of the circumferential wall 7*a* located on the upper and lower sides of the slit 14, by which the positioning of the closure member 8 in the longitudinal direction of the tank main body 7 is also performed. Although not illustrated in detail, each of the upper and lower closure members 8 of the left header tank 2 and the lower closure member 8 of the right header tank 3 is brazed to the circumferential wall 7*a* of the corresponding tank main body 7 in the above-described manner.

Insertion openings (through-holes) 17 for receiving corresponding end portions of the side plates 6 are formed in a left-side portion of the circumferential wall 7*a* of the tank main body 7 of the right header tank 3 at positions on the outer sides of the closure members 8 as viewed in the longitudinal direction of the tank main body 7 (at a position above the closure member 8 on the upper side and at a position below the closure member 8 on the lower side). The length of the insertion openings 17 in the circumferential direction of the circumferential wall 7*a* of the tank main body 7 is equal to the width of the side plates 6 as measured in the air-passing direction. In a state in which a right end portion of the upper side plate 6 is inserted into the corresponding insertion opening 17, the right end portion of the upper side plate 6 is brazed to the circumferential wall 7*a* of the corresponding tank main body 7. Although not illustrated in detail, a left end portion of the upper side plate 6, and let and right end portions of the lower side plate 6 are brazed to the circumferential walls 7*a* of the corresponding tank main bodies 7 in the above-described manner.

Drain openings 18 are formed in the circumferential wall 7*a* of the tank main body 7 of the right header tank 3 at positions located on the outer sides of the closure members 8 as viewed in the longitudinal direction of the tank main body (at a position above the closure member 8 on the upper side and at a position below the closure member 8 on the lower side) such that the drain openings 18 do not interfere with the side plates 6. The upper drain opening 18 is formed of a cutout 19 which extends from an edge portion of the slit 14 located on the outer side in the vertical direction (an edge portion of the slit 14 located on the outer side in the longitudinal direction of the tank main body 7) towards the upper end surface of the circumferential wall 7*a* of the tank main body 7 and whose outer end as viewed in the vertical direction (whose outer end as viewed in the longitudinal direction of the tank main body 7) is located between the slit 14 and the upper end surface of the circumferential wall 7*a* of the tank main body 7. A portion of the surface of the closure member 8 which faces outward in the longitudinal direction of the tank main body 7 forms a portion of the peripheral edge of the drain opening 18. Although not illustrated in detail, the above-described drain opening 18 is formed in each of upper and lower end portions of the left header tank 2 and a lower end portion of the right header tank 3.

After all the components of the condenser 1 are assembled and provisionally fixed together, a flux suspension is applied to necessary portions. Subsequently, all the components are brazed together in a furnace, whereby the condenser 1 is manufactured.

The above-described condenser constitutes a refrigeration cycle using a fluorocarbon refrigerant, in cooperation with a compressor, a gas-liquid separator, a pressure reducer, an evaporator, etc. The refrigeration cycle is mounted on a vehicle as a car air conditioner.

FIGS. 5 to 8 show other embodiments of the condenser to which the present invention is applied.

Figure 5:
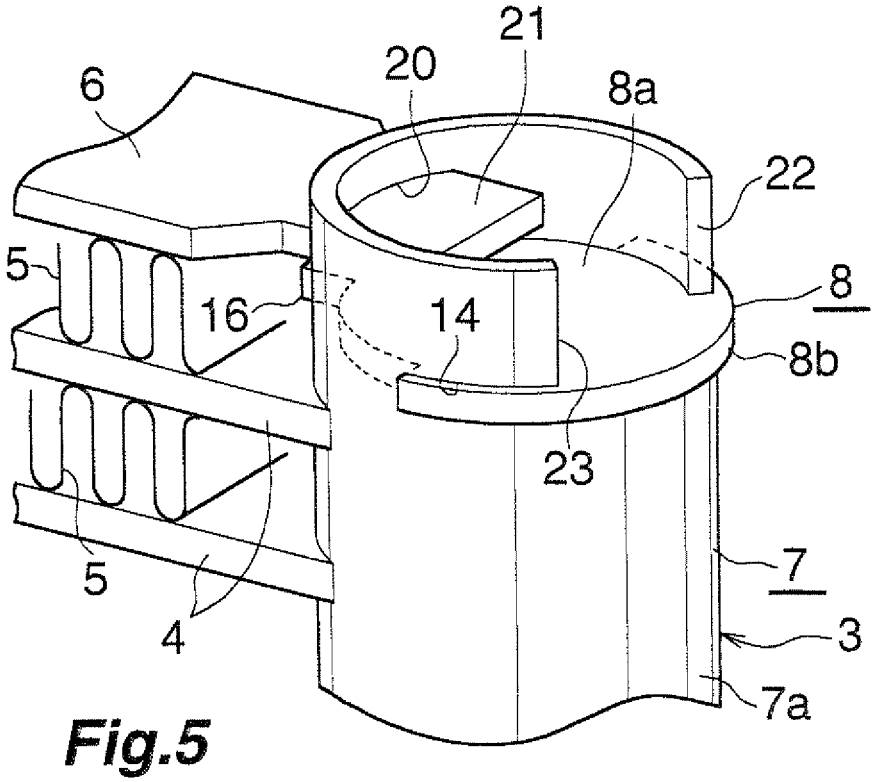
FIG. 5 is a view corresponding to FIG. 3 and showing a second embodiment of the condenser to which the heat exchanger according to the present invention is applied.

In the case of the condenser shown in FIG. 5, a narrow portion 21 is provided at each of opposite ends of each side plate 6. Insertion openings (through-holes) 20 for receiving the corresponding narrow portions 21 of the side plates 6 are formed in a left-side portion of the circumferential wall 7*a* of the tank main body 7 of the right header tank 3 at positions located on the outer sides of the closure members 8 as viewed in the longitudinal direction of the tank main body 7. The length of the insertion openings 20 in the circumferential direction of the circumferential wall 7*a* of the tank main body 7 is shorter than that of the insertion openings 17 of the condenser shown in FIGS. 1 to 4. In a state in which the narrow portion 21 of the upper side plate 6 is inserted into the upper insertion opening 20, the narrow portion 21 is brazed to the circumferential wall 7*a* of the tank main body 7. Although not illustrated, the left end portion of the upper side plate 6 and the left and right end portions of the lower side plate 6 are brazed to the circumferential walls 7*a* of the corresponding tank main bodies 7 in the above-described manner.

Also, a drain opening 22—which is formed in the circumferential wall 7*a* of the tank main body 7 of the right header tank 3 at positions located on the outer sides of the closure members 8 as viewed in the longitudinal direction of the tank main body 7 such that the drain openings 22 do not interfere with the side plates 6—is formed of a cutout 23 which extends from the upper end surface of the circumferential wall 7*a* of the tank main body 7 toward the slit 14 and reaches an edge portion of the slit 14 located on the outer side in the vertical direction. Although not illustrated, the above-described drain opening 22 is formed in each of the upper and lower end portions of the left header tank 2 and the lower end portion of the right header tank 3 in the above-described manner.

The structure of the remaining portion is identical to that of the condenser 1 shown in FIGS. 1 to 4.

Figure 6:
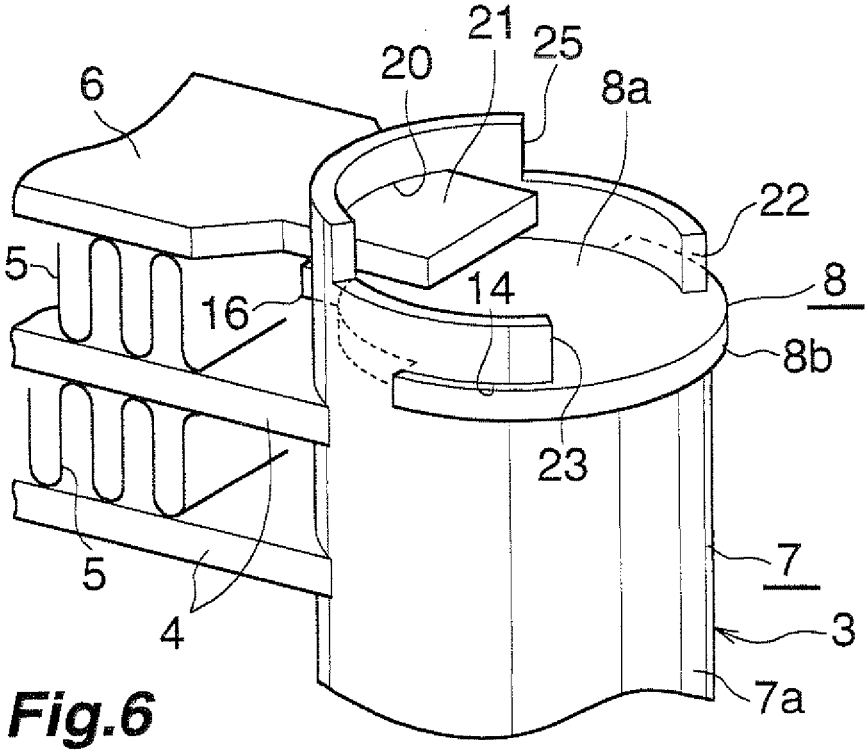
FIG. 6 is a view corresponding to FIG. 3 and showing a third embodiment of the condenser to which the heat exchanger according to the present invention is applied.

In the case of the condenser shown in FIG. 6, a portion of the circumferential wall 7*a* of the tank main body 7, which portion includes the cutout 23 and is located on the outer side of the upper closure member 8 as viewed in the longitudinal direction of the tank main body 7 is partially cut and removed. This cut portion is indicated by 25. Only a portion which includes the upper insertion opening 20 and which has a predetermined length in the circumferential direction remains. Although not illustrated, the above-described drain opening 25 is formed in each of the upper and lower end portions of the tank main body 7 of the left header tank 2 and the lower end portion of the tank main body 7 the right header tank 3.

The structure of the remaining portion is identical to that of the condenser 1 shown in FIG. 5.

Figure 7:
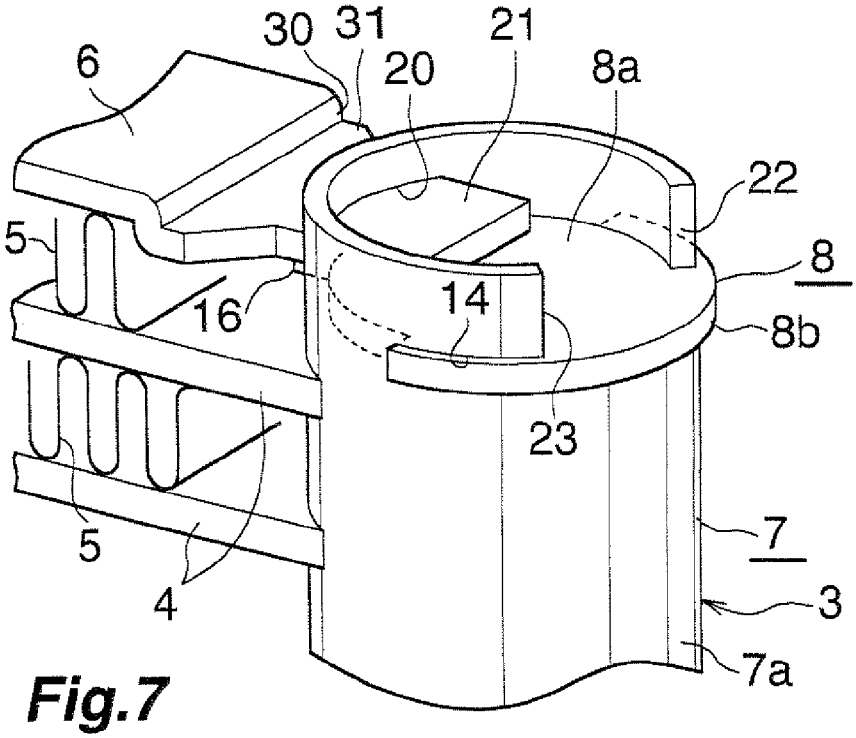
FIG. 7 is a view corresponding to FIG. 3 and showing a fourth embodiment of the condenser to which the heat exchanger according to the present invention is applied.

In the case of the condenser shown in FIG. 7, an offset portion 31 is provided at the right end of the upper side plate 6 via a step portion 30 such that the offset portion 31 is offset inward in the vertical direction, and the above-mentioned narrow portion 21 is provided at the distal end of the offset portion 31. The surface of the side plate 6 (excluding the step portion 30 and the offset portion 31) located on the outer side in the vertical direction is located on the same plane as the upper end surface of the circumferential wall 7*a* of the tank main body 7. Although not illustrated, the left end portion of the upper side plate 6 and the left and right end portions of the lower side plate 6 are configured as described above.

The structure of the remaining portion is identical to that of the condenser 1 shown in FIG. 5.

Figure 8:
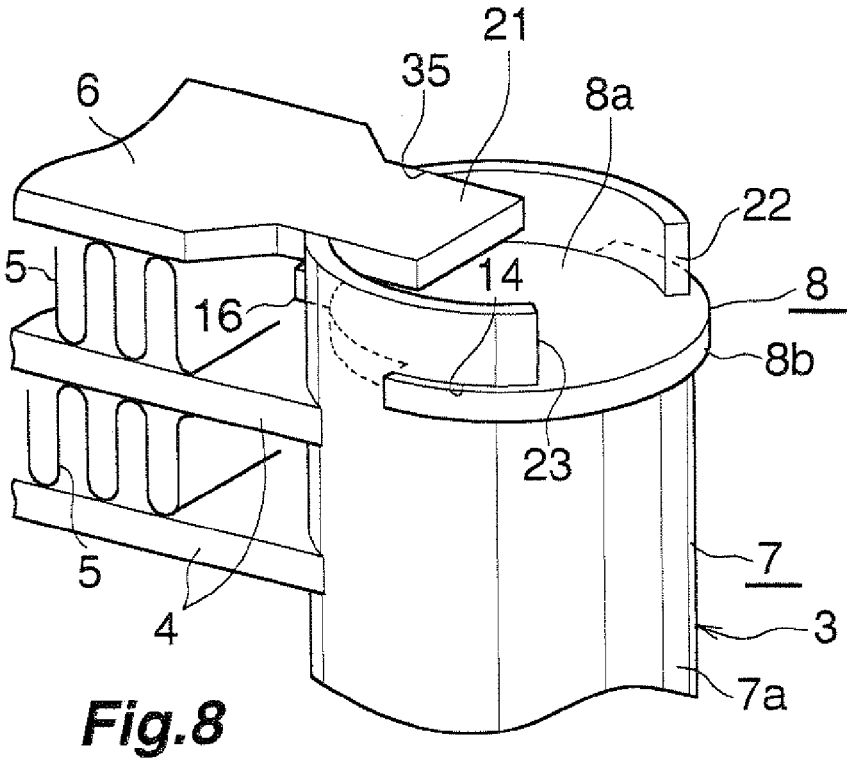
FIG. 8 is a view corresponding to FIG. 3 and showing a fifth embodiment of the condenser to which the heat exchanger according to the present invention is applied.

In the case of the condenser shown in FIG. 8, a left-side portion of the circumferential wall 7*a* of the tank main body 7 of the right header tank 3 has an insertion opening 35 which is formed of a cutout which extends from the upper end surface of the circumferential wall 7*a* toward the heat exchange tube 4 and which receives the narrow portion 21 of the upper side plate 6. In a state in which the narrow portion 21 of the upper side plate 6 is inserted into the insertion opening 35, the narrow portion 21 is brazed to the circumferential wall 7*a* of the tank main body 7. Although not illustrated, the left end portion of the upper side plate 6 and the left and right end portions of the lower side plate 6 are brazed to the circumferential walls 7*a* of the corresponding tank main bodies 7 in the above-described manner.

In all the embodiments described above, as shown in the drawings, solid plates are used for the side plates 6. However, side plates which are formed of hollow tubes having the same structure as the heat exchange tubes 4 may be used.

What is claimed is:

1. A heat exchanger comprising:

a pair of header tanks disposed apart from each other;

a plurality of heat exchange tubes disposed in parallel between the header tanks and having opposite end portions connected to the respective header tanks;

fins disposed between adjacent heat exchange tubes and on the outer sides of the heat exchange tubes at opposite ends; and side plates which are disposed on the outer sides of the fins at the opposite ends and whose opposite ends are joined to the corresponding header tanks, each of the header tanks having a tubular tank main body which is open at opposite ends thereof, and closure members which close the openings of the tank main body at opposite ends thereof, wherein slits are formed in a circumferential wall of the tank main body of each header tank at positions between opposite end surfaces of the circumferential wall and the heat exchange tubes at the opposite ends such that the slits extend in the circumferential direction of the circumferential wall;

the closure members each having a plate-like shape are inserted into the slits from the outer side of the tank main body and are joined to the circumferential wall of the tank main body;

insertion openings for receiving corresponding ones of opposite ends of the side plates are formed in the circumferential wall of the tank main body of each header tank at positions on the outer sides of the closure members as viewed in the longitudinal direction of the tank main body;

the opposite ends of the side plates are inserted into the insertion openings of the circumferential walls of the tank main bodies of the two header tanks and are joined to the circumferential walls of the tank main bodies;

drain openings are formed in the circumferential wall of the tank main body of each header tank at positions on the outer sides of the closure members as viewed in the longitudinal direction of the tank main body; and a portion of a surface of each closure member which faces outward in the longitudinal direction of the tank main body forms a portion of a peripheral edge of the corresponding drain opening.

2. A heat exchanger according to claim 1, wherein the slits are formed in a portion of the circumferential wall of each tank main body located on the side opposite the side where the heat exchange tubes are connected to the tank main body, each closure member has a main body portion which closes a space surrounded by the circumferential wall of the tank main body, and an outward projecting portion unitarily formed at a portion of the peripheral edge of the main body portion, and an outer edge portion of the outward projecting portion extends through the corresponding slit to the outside of the circumferential wall of the tank main body.

3. A heat exchanger according to claim 2, wherein each closure member has a protrusion which is provided at the peripheral edge of the main body portion to be located on the side opposite the outward projecting portion, and the protrusion is inserted into a through-hole which is formed in a portion of the circumferential wall of the tank main body on the side where the heat exchange tubes are connected to the tank main body.

4. A heat exchanger according to claim 1, wherein each drain opening is a cutout which is formed in the circumferential wall of the tank main body, and the cutout extends from a corresponding end surface of the circumferential wall of the tank main body toward the corresponding slit and reaches an edge portion of the slit located on the outer side in the longitudinal direction of the tank main body.

5. A heat exchanger according to claim 1, wherein each drain opening is a cutout which is formed in the circumferential wall of the tank main body, and the cutout extends from an edge portion of the slit located on the outer side in the longitudinal direction of the tank main body, toward the corresponding end surface of the circumferential wall of the tank main body, and an end portion of the cutout on the outer side in the longitudinal direction of the tank main body is located between the slit and the corresponding end surface of the circumferential wall of the tank main body.

6. A heat exchanger according to claim 1, wherein the insertion openings of the circumferential wall of each tank main body are cutouts which are formed in the circumferential wall of the tank main body such that the cutouts extend from opposite end surface of the circumferential wall of the tank main body.

7. A heat exchanger according to claim 1, wherein the insertion openings of the circumferential wall of each tank main body are through-holes which are formed in the circumferential wall of the tank main body.

* * * * *